US008618892B2

(12) United States Patent
Iida

(10) Patent No.: US 8,618,892 B2
(45) Date of Patent: Dec. 31, 2013

(54) COMMUNICATION DEVICE AND COMMUNICATION SYSTEM

(75) Inventor: Sachio Iida, Chiba (JP)

(73) Assignee: Sony Corporation, Tokyo (JP)

( * ) Notice: Subject to any disclaimer, the term of this patent is extended or adjusted under 35 U.S.C. 154(b) by 397 days.

(21) Appl. No.: 13/085,858

(22) Filed: Apr. 13, 2011

(65) Prior Publication Data

US 2011/0254643 A1 Oct. 20, 2011

(30) Foreign Application Priority Data

Apr. 20, 2010 (JP) ..... 2010-096892

(51) Int. Cl.
*H01P 5/00* (2006.01)
*H01P 1/00* (2006.01)

(52) U.S. Cl.
USPC ..... 333/24 R; 333/112; 333/156

(58) Field of Classification Search
USPC ..... 333/24 R, 109, 110, 112, 117, 116, 156
See application file for complete search history.

(56) References Cited

U.S. PATENT DOCUMENTS

| | | | | |
|---|---|---|---|---|
| 5,557,290 | A * | 9/1996 | Watanabe | 343/713 |
| 5,634,200 | A * | 5/1997 | Kitakubo et al. | 455/82 |
| 7,116,966 | B2 * | 10/2006 | Hattori et al. | 455/334 |
| 7,750,851 | B2 | 7/2010 | Washiro | |
| 8,022,787 | B2 * | 9/2011 | Inoue et al. | 333/110 |
| 8,299,868 | B2 * | 10/2012 | Kato et al. | 333/24 R |
| 8,457,551 | B2 * | 6/2013 | Iida | 455/41.1 |

FOREIGN PATENT DOCUMENTS

| | | |
|---|---|---|
| JP | 4345849 | 7/2009 |

* cited by examiner

*Primary Examiner* — Dean O Takaoka
(74) *Attorney, Agent, or Firm* — Wolf, Greenfield & Sacks, P.C.

(57) ABSTRACT

There is provided a communication system including a transmitter and a receiver, each including a communication circuit unit that processes a high-frequency signal for transmitting data, a band-pass filter, and a high frequency coupler, a distributed constant line connecting the high frequency coupler and the band-pass filter of the transmitter, and a distributed constant line connecting the high frequency coupler and the band-pass filter of the receiver, wherein an electrical length of the distributed constant line of the transmitter is different from an electrical length of the distributed constant line of the receiver.

12 Claims, 12 Drawing Sheets

$$\frac{a_l}{b_s} = \left(\frac{1}{1-BS_{22}CS_{11}}\right)\left(\frac{1}{1-CS_{22}BS_{22}}\right)BS_{21}CS_{21}BS_{12} \cdots\cdots (1)$$

$$\frac{a_l}{b_S} = \left\{\frac{1}{1-2BS_{22}CS_{11}+BS_{22}{}^{2}CS_{11}{}^{2}}\right\}BS_{21}CS_{21}BS_{12} \cdots\cdots\cdots (2)$$

COMMUNICATION DEVICE AND COMMUNICATION SYSTEM

BACKGROUND OF THE INVENTION

1. Field of the Invention

The present invention relates to a communication device and a communication system and, particularly, to a communication device and a communication system used in close proximity.

2. Description of the Related Art

When moving data between small-size information devices, a method of moving data through data communication by interconnection between the information devices using a general-purpose cable such as a USB cable or through a medium such as a memory card is generally used.

In addition, information devices incorporating various cable-less communication functions are provided. As a method of performing cable-less data communication between small-size information devices, radio frequency communication that transmits and receives radio signals using antennas, including wireless LAN such as IEEE802.11 and Bluetooth (registered trademark) communication, is developed. In the radio frequency communication, a wireless interface can be used when exchanging data such as images and music with a personal computer, and there is no need to insert and withdraw a connector to connect a cable for each data communication, thus offering enhanced user-friendliness.

Further, a close proximity wireless communication system that uses a high frequency coupler rather than an antenna and achieves wireless communication in a short distance of several centimeters utilizing electric field coupling by an electrostatic field or an induction field has been proposed recently (cf. e.g. Japanese Patent No. 4345849). In the close proximity wireless communication system, a communication distance is as short as several centimeters to prevent crosstalk with wireless LAN, Bluetooth (registered trademark) communication or the like. Therefore, the close proximity wireless communication system enables broadband communication without interference with another communication system. Further, the close proximity wireless communication system enables high-speed data transfer, thus achieving transfer of high-volume data in a short time, such as transfer of digital camera images or transfer of digital video camera high-definition pictures.

SUMMARY OF THE INVENTION

Because the high frequency coupler utilizes electric field coupling by an electrostatic field or an induction field, if the high frequency coupler to be coupled with is located within a short distance of about 5 millimeters, VSWR (Voltage Standing Wave Ratio) is a small value of 2 or less, and impedance matching is obtained. At this time, it is considered that the two high frequency couplers on the transmitting side and the receiving side are coupled by a quasi-electrostatic field.

On the other hand, when the high frequency couplers are located at a distance of 10 millimeters or more, VSWR is a relatively large value, and impedance mismatching occurs. At this time, it is considered that the two high frequency couplers are coupled by an induction field.

The curve A in FIG. 14 indicates an ideal transfer characteristic in the case where the term in parentheses of the following Equation 1 is omitted on the assumption that impedance matching is obtained. On the other hand, the curve B indicates an actual transfer characteristic in the case where the term in parentheses is not omitted (thus, impedance mismatching occurs in the high frequency coupler), showing that a large ripple of about 2.5 dB measured as a peak to peak value (=C1+C2) is occurring.

$$\frac{a_t}{b_s} = \left(\frac{1}{1 - BS_{22}CS_{11}}\right)\left(\frac{1}{1 - CS_{22}BS_{22}}\right)BS_{21}CS_{21}BS_{12} \quad \text{[Equation 1]}$$

In light of the foregoing, it is desirable to provide novel and improved communication device and communication system capable of providing good broadband characteristics without degrading a frequency characteristic of a band-pass filter even with an impedance mismatch of a high frequency coupler in close proximity wireless communication utilizing an electrostatic field or an induction field between information devices.

According to an embodiment of the present invention, there is provided a communication device which includes a transmitter and a receiver, each including a communication circuit unit that processes a high-frequency signal for transmitting data, a band-pass filter, and a high frequency coupler, a distributed constant line connecting the high frequency coupler and the band-pass filter of the transmitter, and a distributed constant line connecting the high frequency coupler and the band-pass filter of the receiver, wherein an electrical length of the distributed constant line of the transmitter is different from an electrical length of the distributed constant line of the receiver.

FIG. 3 indicates the relationship between the electrical lengths of the distributed constant lines mounted in the transmitter and the receiver in FIG. 1. The vertical axis indicates the electrical length of the distributed constant line of the transmitter at 4.5 GHz and the horizontal axis indicates the electrical length of the distributed constant line of the receiver at 4.5 GHz. According to this, it will be understood that the electrical lengths of the distributed constant lines mounted in the transmitter and the receiver become closer to each other, a large ripple occurs.

In contrast, according to the above configurations, an electrical length of the distributed constant line connecting the high frequency coupler and the band-pass filter of the communication device (one of the transmitter or the receiver) is different from an electrical length of the distributed constant line connecting the high frequency coupler and the band-pass filter of another of the transmitter or the receiver. According to this, the occurrence of a ripple can be minimized. As a result, even if there is an impedance mismatch of the high frequency couplers, it is possible to provide good broadband characteristics without degrading the frequency characteristics of the band-pass filters.

The electrical length of the distributed constant line may be set to produce a phase difference of 90°±180°×n (n is an integer of 0 or greater) with respect to the electrical length of the distributed constant line of the transmitter or the receiver at another of data communication.

The electrical length of the distributed constant line may be set to produce a phase difference of 90° with respect to the electrical length of the distributed constant line of the transmitter or the receiver at another of data communication.

The distributed constant line may be a microstrip line formed on a printed board.

The distributed constant line may be a coaxial cable.

The distributed constant line may be a transmission line formed in a part of the high frequency coupler.

According to another embodiment of the present invention, there is provided a communication system which includes a transmitter and a receiver, each including a communication circuit unit that processes a high-frequency signal for transmitting data, a band-pass filter, and a high frequency coupler, a distributed constant line connecting the high frequency coupler and the band-pass filter of the transmitter, and a distributed constant line connecting the high frequency coupler and the band-pass filter of the receiver, wherein an electrical length of the distributed constant line of the transmitter is different from an electrical length of the distributed constant line of the receiver.

According to another embodiment of the present invention, there is provided a communication device which includes a communication circuit unit that processes a high-frequency signal for transmitting data, a band-pass filter, a high frequency coupler, and a phase shift circuit placed between the high frequency coupler and the band-pass filter, wherein the communication device functions as at least one of a transmitter and a receiver, a phase angle of the phase shift circuit is different from a phase angle of a phase shift circuit placed between a high frequency coupler and a band-pass filter of a transmitter or a receiver at another of data communication.

The phase shift circuit may be set to produce a phase difference of 90°±180°×n (n is an integer of 0 or greater) with respect to the phase shift circuit of the transmitter or the receiver at another of data communication.

The phase shift circuit may be set to produce a phase difference of 90° with respect to the phase shift circuit of the transmitter or the receiver at another of data communication.

The phase shift circuit may be a lumped constant circuit composed of an inductor or a capacitor.

According to another embodiment of the present invention, there is provided a communication system which includes a transmitter and a receiver, each including a communication circuit unit that processes a high-frequency signal for transmitting data, a band-pass filter, and a high frequency coupler, a phase shift circuit placed between the high frequency coupler and the band-pass filter of the transmitter, and a phase shift circuit placed between the high frequency coupler and the band-pass filter of the receiver, wherein a phase angle of the phase shift circuit of the transmitter is different from a phase angle of the phase shift circuit of the receiver.

According to the embodiments of the present invention described above, it is possible to provide good broadband characteristics without degrading a frequency characteristic of a band-pass filter even with an impedance mismatch of a high frequency coupler in close proximity wireless communication utilizing an electrostatic field or an induction field between information devices.

DETAILED DESCRIPTION OF THE EMBODIMENT(S)

Figure 1:
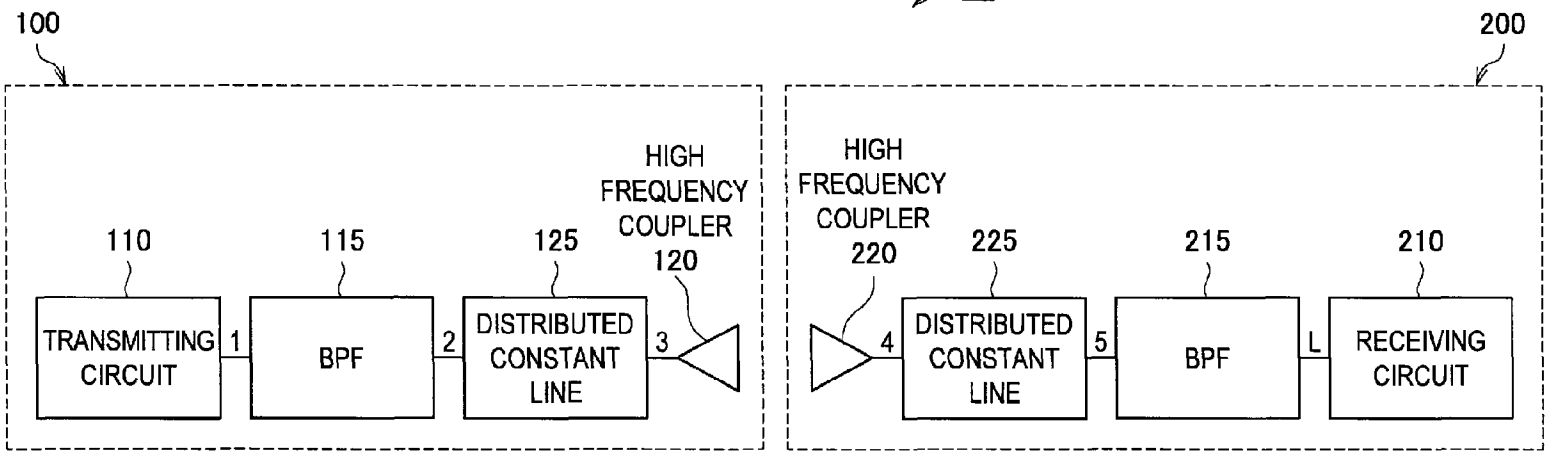
FIG. 1 is an overall block diagram of a close proximity wireless communication system according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Embodiments of the present invention will be described in the following order.

<Description of Related Art>

[Overall Configuration of Close Proximity Wireless Communication System according to Related Art]

[Signal Flow Graph of Transmission Line and Its Simplification]

[Transfer Characteristic]

<First Embodiment>

[Overall Configuration of Close Proximity Wireless Communication System According to First Embodiment]

[Signal Flow Graph of Transmission Line and its Simplification]

[Transfer Characteristic]

[Specific Configuration according to First Embodiment]

[Specific Configuration according to Alternative Example 1]

[Specific Configuration according to Alternative Example 2]

<Second Embodiment>

[Specific Configuration according to Second Embodiment]

DESCRIPTION OF RELATED ART

Prior to describing a close proximity wireless communication system according to a first embodiment of the present invention, a communication system disclosed in Japanese Patent No. 4345849 is described as related art with reference to FIGS. 10 to 14.

[Overall Configuration of Close Proximity Wireless Communication System according to Related Art]

Japanese Patent No. 4345849 discloses a technique related to a close proximity wireless communication system 90 using a high frequency coupler. Some small-size information device constituting the close proximity wireless communication system 90 is equipped with a band-pass filter to avoid interference from another communication system in cases where another communication system such as wireless LAN is mounted in the same housing.

As described above, the high frequency coupler fails to attain impedance matching when a coupler to be coupled with is apart. This is because a typical band-pass filter is designed to satisfy transfer characteristics at a frequency characteristic when both ends are terminated with a characteristic impedance of 50Ω. Therefore, broadband characteristics with a good frequency characteristic are not always obtained when the high frequency coupler and the band-pass filter are connected.

Figure 10:
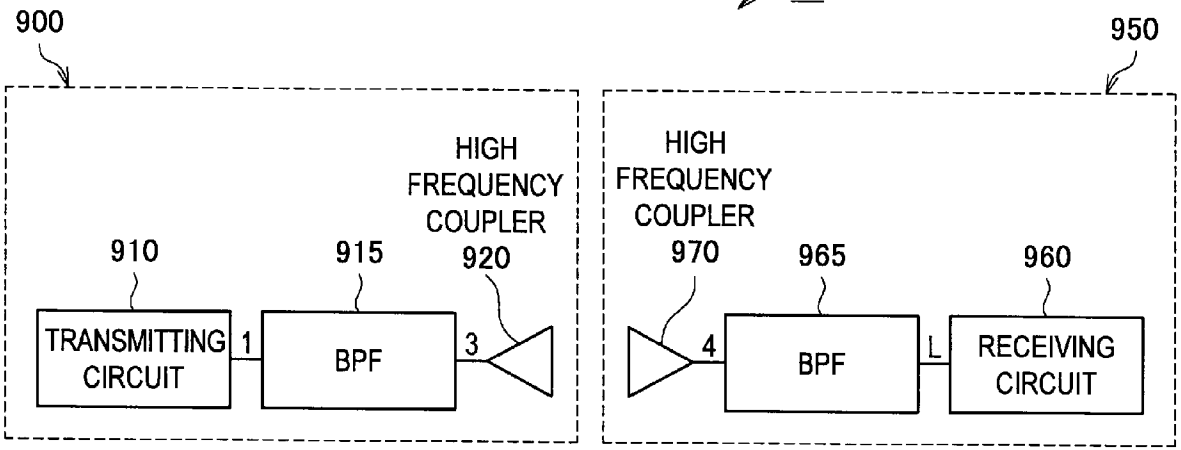
FIG. 10 is an overall block diagram of a close proximity wireless communication system according to related art.

FIG. 10 shows the close proximity wireless communication system 90 equipped with a band-pass filter (BPF). A transmitter 900 includes a transmitting circuit 910, a BPF 915 (transmitting-side band-pass filter), and a high frequency coupler 920 (transmitting-side coupler). A receiver 950 includes a receiving circuit 960, a BPF 965 (receiving-side band-pass filter), and a high frequency coupler 970 (receiving-side coupler). Note that the transmitter 900 and the receiver 950 have the same configuration, and the same component is used for the BPF 915 and the BPF 965, and the high frequency coupler 920 and the high frequency coupler 970, respectively.

The transmitter 900 and the receiver 950 may function as a receiver and a transmitter, respectively, by two-way communication in some cases. Specifically, although the transmitter 900 transmits data and the receiver 950 receives data at the present moment, when transmitting and receiving ends of data become reversed, the receiver 950 acts as a transmitter and transmits data, and the transmitter 900 acts as a receiver and receives data.

Frequency characteristics of the BPFs 915 and 965 and the high frequency couplers 920 and 970 are measured in S-parameters, and the BPFs 915 and 965 are 2 port S parameters between two terminals, and the high frequency couplers 920 and 970 are 2 port S parameters in the state of being opposed and coupled to each other. Hereinafter, a transmission line of the close proximity wireless communication system 90 is analyzed by a signal flow graph to examine the effect of an impedance mismatch.

[Signal Flow Graph of Transmission Line and its Simplification]

Figure 11:
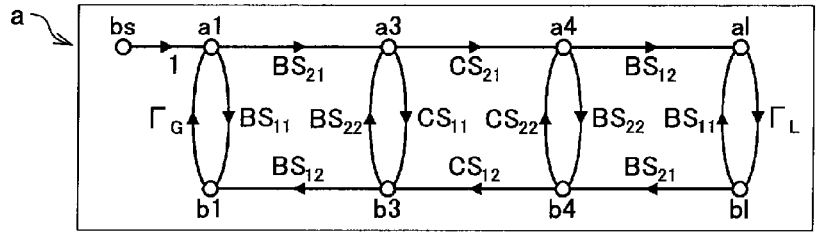
FIG. 11 is a view showing a signal flow graph of a transmission line according to related art.
Figure 11:
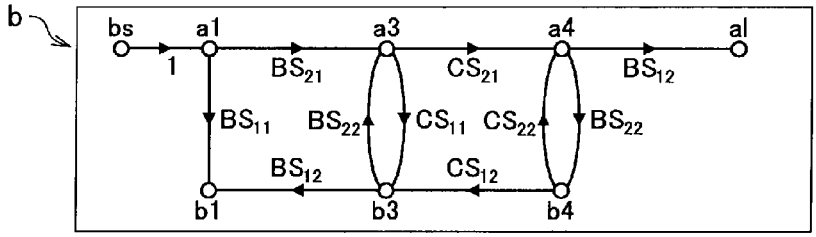
Figure 11:
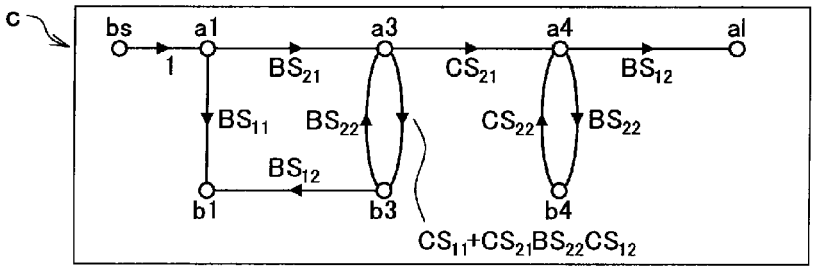
Figure 11:
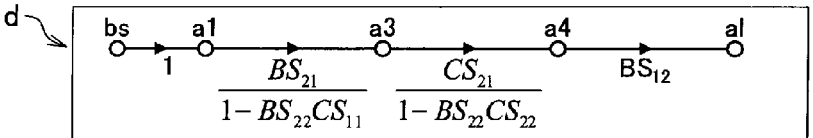

FIG. 11 shows a signal flow graph of a transmission line. "bs" shown in the signal flow graph a in FIG. 11 is an output signal from the transmitting circuit 910. "a1" is an incident signal headed from left to right at the point 1 shown in FIG. 10. "a3" is an incident signal headed from left to right at the point 3 shown in FIG. 10. "a4" is an incident signal headed from left to right at the point 4 shown in FIG. 10. "a1" is an input signal to the receiving circuit 960.

"b1" is a reflected signal headed from right to left at the point L shown in FIG. 10. "b4" is a reflected signal headed from right to left at the point 4 shown in FIG. 10. "b3" is a reflected signal headed from right to left at the point 3 shown in FIG. 10. "b1" is a reflected signal headed from right to left at the point 1 shown in FIG. 10. $\Gamma_G$ is a reflection coefficient of the transmitting circuit 910, and $\Gamma_L$ is a reflection coefficient of the receiving circuit 960. BS11, BS21, BS12 and BS22 are 2 port S parameters of the BPFs 915 and 965. CS11, CS21, CS12 and CS22 are 2 port S parameters in the state where the high frequency couplers 920 and 970 are coupled.

If it is assumed that $\Gamma_G$ and $\Gamma_L$ are 0 for easier analysis, there is no reflection from the receiving circuit 960 and thus b1 is 0, and the signal flow graph a of the transmission line is omissible like the signal flow graph b in FIG. 11. Further, organizing the path of a3→a4→b4→b3 in the signal flow graph b gives simplification as in the signal flow graph c in FIG. 11.

The second term $CS_{21}BS_{22}CS_{12}$ added to the path of a3→b3 is the product of roundtrip propagation losses $CS_{21}$ and $CS_{12}$ of the high frequency coupler and $BS_{22}$ of the BPF and becomes small enough, which is thus omissible. Calculating a signal flow from bs to a1 in consideration of the omission gives the signal flow graph d in FIG. 11, and the transfer characteristic is as represented by Equation 1. Expanding Equation 1 gives Equation 2 shown in FIG. 11.

A part of Equations 1 and 2 enclosed in parentheses indicates an impedance mismatch. Thus, when Equations 1 and 2 have only the term $BS_{21}CS_{21}BS_{12}$ outside parentheses, an impedance mismatch is removed, and there is no reflection in the path of bs→a1→a1, and an ideal transfer characteristic is obtained.

[Transfer Characteristic]

Figure 12:
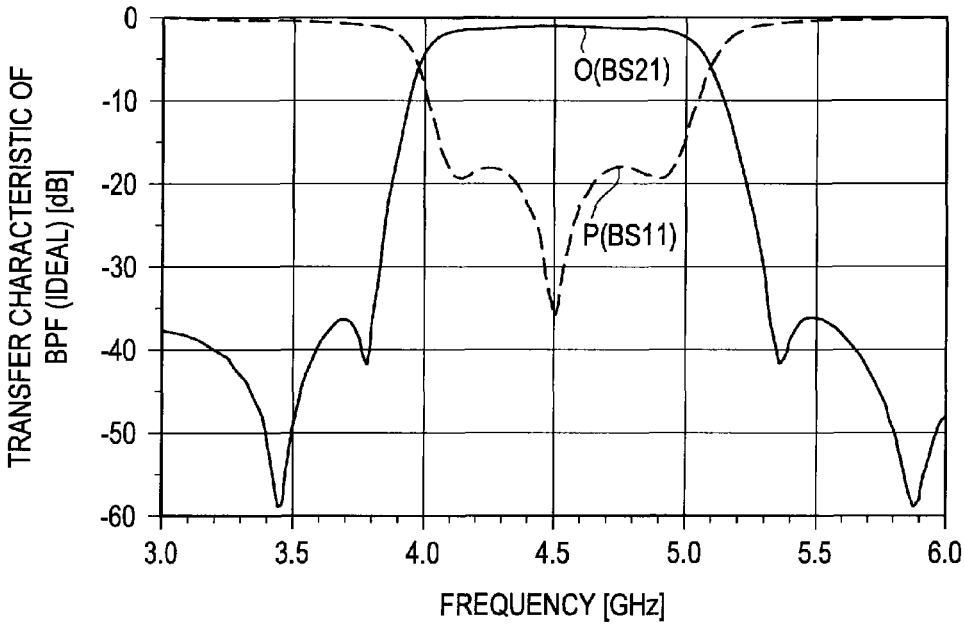
FIG. 12 is a graph showing transfer characteristics of an ideal fifth order band-pass filter.
Figure 13:
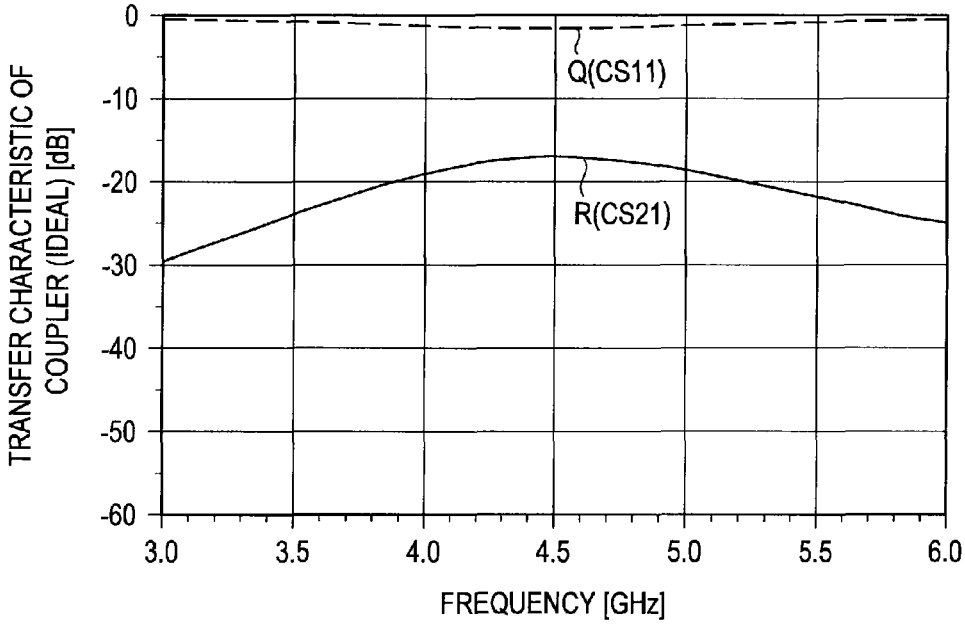
FIG. 13 is a graph showing transfer characteristics in the case of simulation using an ideal coupler.
Figure 14:
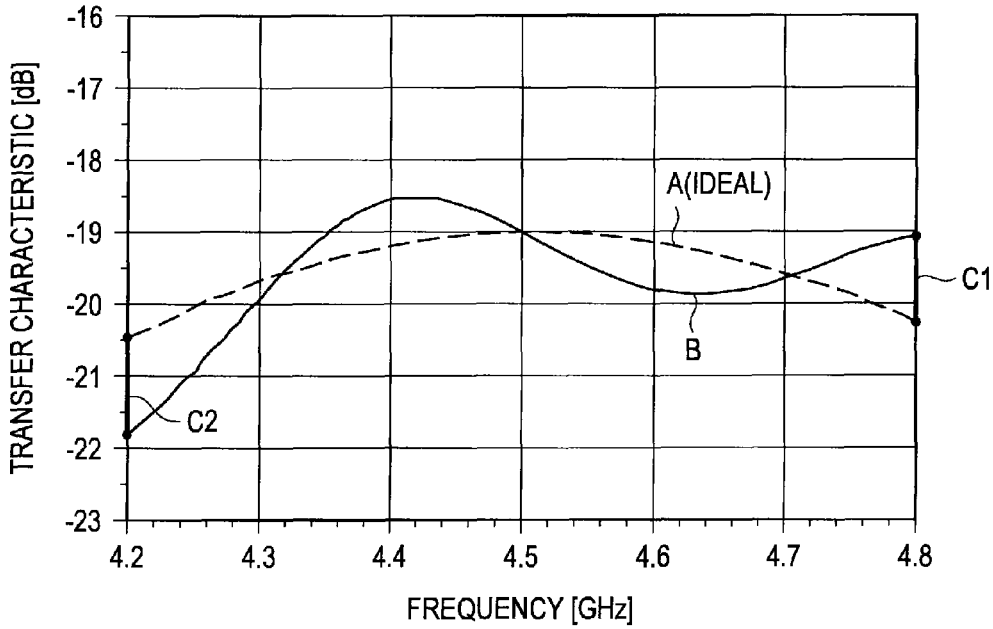
FIG. 14 is a graph comparing transfer characteristics in the case where impedance matching is obtained and in the case of a close proximity wireless communication system according to related art.

As a specific example, numerical simulation using an ideal fifth order BPF (a BPF of O(BS21), P(BS11)) shown in FIG. 12 and an ideal coupler (a coupler of Q(CS11), R(CS21)) shown in FIG. 13 derives the transfer characteristic shown in FIG. 14.

The curve A in FIG. 14 indicates an ideal transfer characteristic where the term in parentheses of Equation 1 is omitted on the assumption that impedance matching is obtained. On the other hand, the curve B indicates an actual transfer characteristic in consideration of an impedance mismatch of the high frequency coupler, which shows that a large ripple of about 2.5 dB measured as a peak to peak value (=C1+C2) is occurring.

On the contrary to the above-described related art, each embodiment described hereinbelow provides a close proximity wireless communication system in a short distance of several centimeters, which provides good broadband characteristics without degrading a frequency characteristic of a band-pass filter by suppressing the occurrence of a ripple even when an impedance mismatch of a high frequency coupler is occurring.

First Embodiment

[Overall Configuration of Close Proximity Wireless Communication System according to First Embodiment]

An overall configuration of a close proximity wireless communication system according to a first embodiment of the present invention is described firstly with reference to FIG. 1.

FIG. 1 shows a close proximity wireless communication system 10 equipped with a distributed constant line according to the embodiment. A transmitter 100 includes a transmitting circuit 110, a BPF 115 (transmitting-side band-pass filter), a high frequency coupler 120 (transmitting-side coupler), and a distributed constant line 125. A receiver 200 includes a receiving circuit 210, a BPF 215 (receiving-side band-pass filter), a high frequency coupler 220 (receiving-side coupler), and a distributed constant line 225. The transmitter 100 and the receiver 200 have the same configuration, and the same component is used for the BPF 115 and the BPF 215, and the high frequency coupler 120 and the high frequency coupler 220, respectively.

The transmitter 100 and the receiver 200 may function as a receiver and a transmitter, respectively, by two-way communication depending on occasion. Specifically, although the transmitter 100 transmits data and the receiver 200 receives data at the present moment, when transmitting and receiving ends of data become reversed, the receiver 200 acts as a transmitter, and the transmitter 100 acts as a receiver.

Therefore, the transmitting circuit 110 and the receiving circuit 210 are communication circuits that function both as a transmitting circuit and a receiving circuit and process high-frequency signals for transmitting data, which correspond to communication circuit units. Further, the transmitter 100 and the receiver 200 correspond to communication devices that include a communication circuit unit, a band-pass filter, a high frequency coupler and a distributed constant line and that function as at least one of a transmitter and a receiver. The close proximity wireless communication system 10 corresponds to a communication system that includes the transmitter 100 and the receiver 200.

It should be noted that the "system" as referred to herein indicates a logical set of a plurality of devices (or functional modules that implement characteristic functions), and each device or functional module may or may not be within a single housing.

Frequency characteristics of the BPFs 115 and 215, the distributed constant lines 125 and 225, and the high frequency couplers 120 and 220 are measured in S-parameters. The BPFs 115 and 215 and the distributed constant lines 125 and 225 are 2 port S parameters between two terminals, and the high frequency couplers 120 and 220 are 2 port S parameters in the state of being opposed and coupled to each other. Hereinafter, a transmission line of the close proximity wireless communication system 10 is analyzed by a signal flow graph to examine the effect of an impedance mismatch.

[Signal Flow Graph of Transmission Line and its Simplification]

Figure 2:
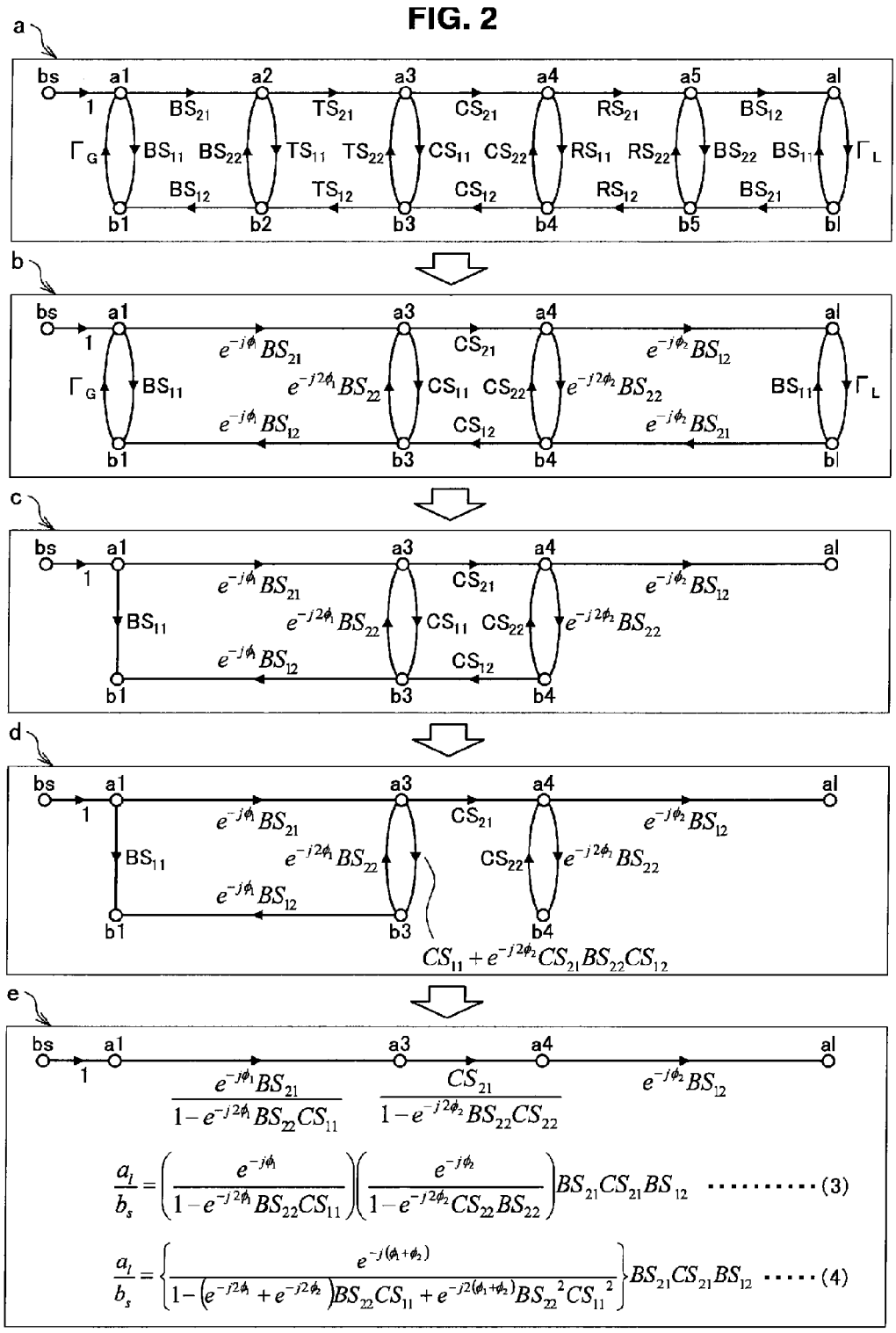
FIG. 2 is a view showing a signal flow graph of a transmission line according to the first embodiment.

FIG. 2 shows a signal flow graph of a transmission line according to the embodiment. In FIG. 2, "bs" is an output signal from the transmitting circuit 110. "a1" is an incident signal headed from left to right at the point 1 shown in FIG. 1. "a2" is an incident signal headed from left to right at the point 2 shown in FIG. 1. "a3" is an incident signal headed from left to right at the point 3 shown in FIG. 1. "a4" is an incident signal headed from left to right at the point 4 shown in FIG. 1. "a5" is an incident signal headed from left to right at the point 5 shown in FIG. 1. "a1" is an input signal to the receiving circuit 210.

"b1" is a reflected signal headed from right to left at the point L shown in FIG. 1. "b5" is a reflected signal headed from right to left at the point 5 shown in FIG. 1. "b4" is a reflected signal headed from right to left at the point 4 shown in FIG. 1. "b3" is a reflected signal headed from right to left at the point 3 shown in FIG. 1. "b2" is a reflected signal headed from right to left at the point 2 shown in FIG. 1. "b1" is a reflected signal headed from right to left at the point 1 shown in FIG. 1. $\Gamma_G$ is a reflection coefficient of the transmitting circuit 110, and $\Gamma_L$ is a reflection coefficient of the receiving circuit 210.

BS11, BS21, BS12 and BS22 are 2 port S parameters of the BPFs 115 and 215. TS11, TS21, TS12 and TS22 are S parameters of the distributed constant line 125. RS11, RS21, RS12 and RS22 are S parameters of the distributed constant line 225. CS11, CS21, CS12 and CS22 are 2 port S parameters in the state where the high frequency couplers 120 and 220 are coupled.

Assuming the use of an ideal distributed constant line, when TS11 and TS22 and RS11 and RS22 are 0, TS21 and TS12 are $e^{-j\phi 1}$, RS21 and RS12 are $e^{-j\phi 2}$, a phase $\phi 1$ and a phase $\phi 2$ are parameters depending on an electrical length of the distributed constant line and a frequency, the signal flow graph a can be rewritten as the signal flow graph b in FIG. 2.

If it is assumed that $\Gamma_G$ and $\Gamma_L$ are 0 for easier analysis, b1 is also 0, and the signal flow graph b is omissible like the signal flow graph c in FIG. 2. Further, organizing the path of a3→a4→b4→b3 in the signal flow graph c gives the signal flow graph d. The second term $e^{-j2\phi 2}CS_{21}BS_{22}CS_{12}$ added to the path of a3→b3 is the product of roundtrip propagation losses $CS_{21}$ and $CS_{12}$ of the high frequency coupler and $BS_{22}$ of the BPF and becomes small enough, which is thus omissible.

If a signal flow from bs to a1 is calculated in consideration of the omission, the signal flow graph e is obtained, and the transfer characteristic is as represented by Equation 3. Expanding Equation 3 gives Equation 4 shown in FIG. 2. A part of Equations 3 and 4 enclosed in parentheses indicates an impedance mismatch.

The third term of the denominator in parentheses of Equation 4 contains the square of $BS_{22}$. Thus, the third term of the denominator in parentheses of Equation 4 is a sufficiently small value, which is thus negligible. Then, the second term of the denominator serves as a dominant term for a frequency characteristic, and further, because $e^{-j2\phi 1}$ and $e^{-j2\phi 2}$ are complex rotation factors with a radius of 1, if the phase $\phi 1$ and the phase $\phi 2$ have a phase difference of 90°, a phase difference of the rotation factors is 180° from $2\times\phi 1$ and $2\times\phi 2$ to cancel out each other, so that the second term can be 0.

[Transfer Characteristic]

For the distributed constant lines 125 and 225 in the close proximity wireless communication system 10 according to the embodiment, numerical simulation is performed using an ideal fifth order BPF shown in FIG. 12 and an ideal coupler shown in FIG. 13 as a specific example, and a peak to peak value of a difference from an ideal transfer characteristic is recorded as a ripple. Parametric sweeping of the phase $\phi 1$ and the phase $\phi 2$ in steps of 10 degrees from 0 to 180 degrees gives the 2D graph of FIG. 3.

Figure 3:
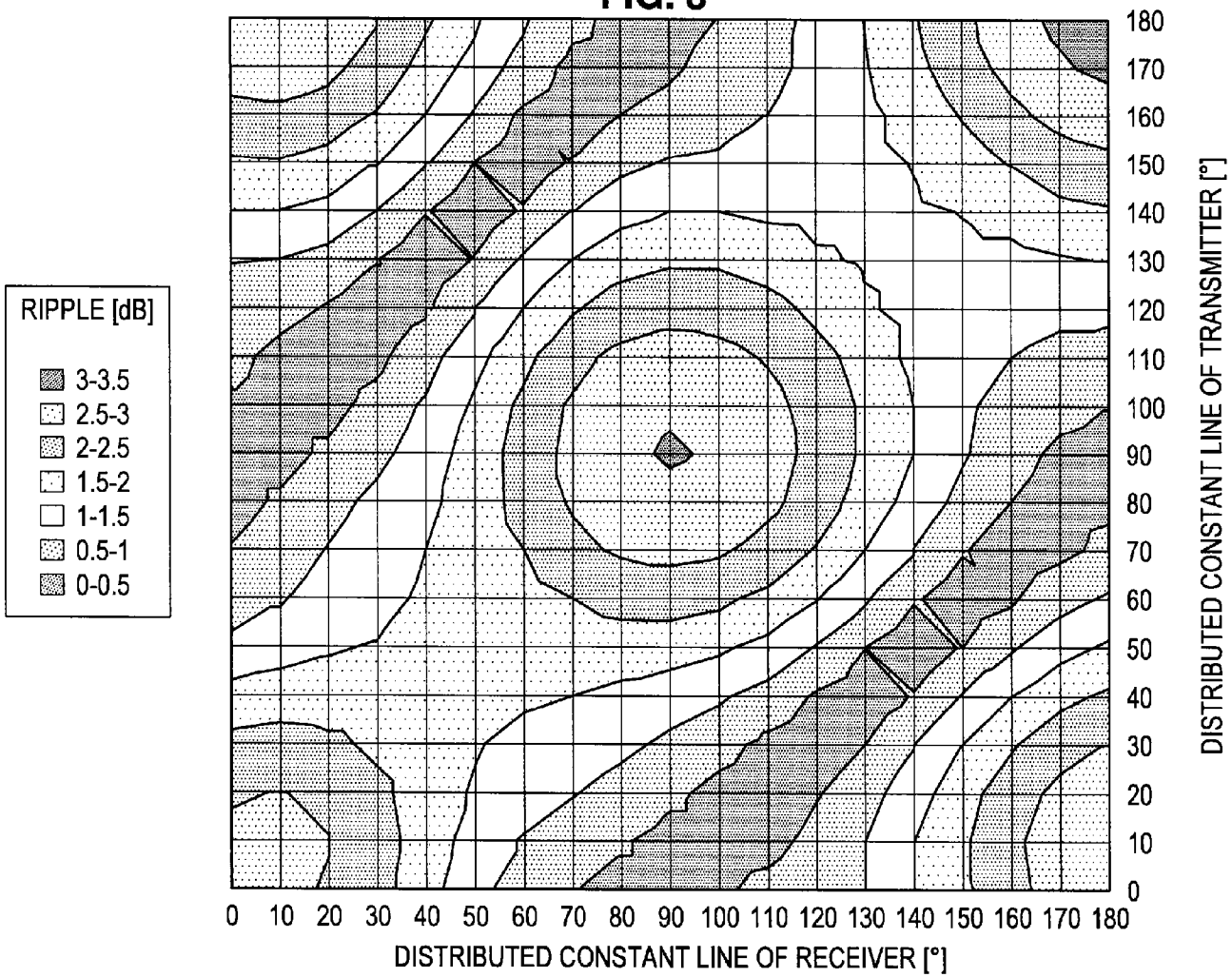
FIG. 3 is a view representing by 2D a relationship between electrical lengths of distributed constant lines of a transmitter and a receiver and a ripple according to the first embodiment.

The vertical axis of the graph in FIG. 3 indicates the electrical length of the distributed constant line 125 of the transmitter at 4.5 GHz, and the horizontal axis indicates the electrical length of the distributed constant line 225 of the receiver at 4.5 GHz. Further, FIG. 4 shows a 3D view of the graph of FIG. 3.

Figure 4:
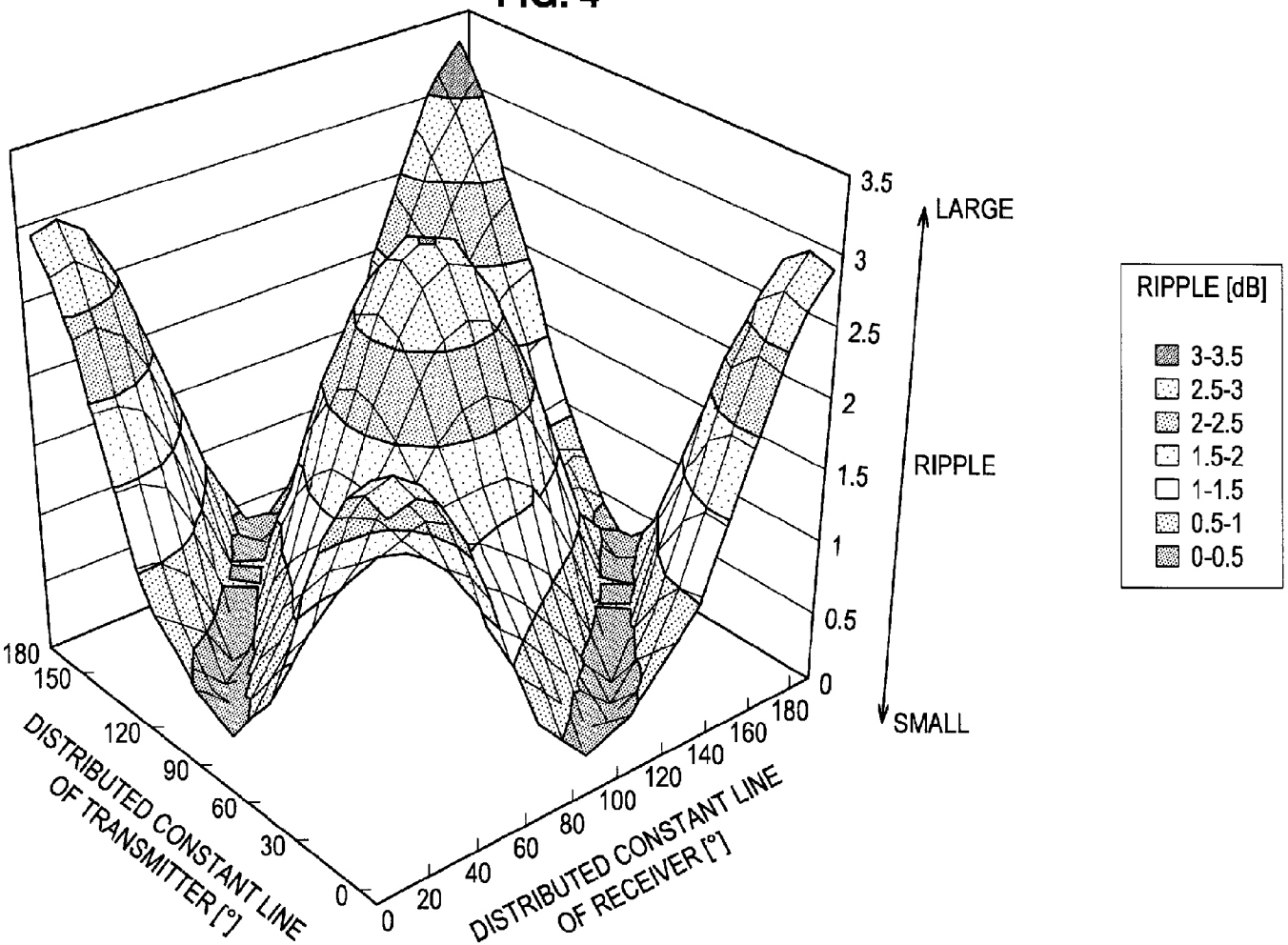
FIG. 4 is a view representing by 3D the relationship shown in FIG. 3.

Examination of FIGS. 3 and 4 shows that a ripple is the smallest when the electrical lengths of the distributed constant lines 125 and 225 of the transmitter 100 and the receiver 200 are set to produce a phase difference of 90°. Because $e^{-j2\phi 1}\zeta e^{-j2\phi 2}$ in the second term of the denominator in parentheses of Equation 4 shown in FIG. 2 are complex rotation factors with a radius of 1, if the phase $\phi 1$ and the phase $\phi 2$ have a phase difference of 90°, a phase difference of the rotation factors is 180° from $2\times\phi 1$ and $2\times\phi 2$ to cancel out each other and make the second term 0, thereby suppressing an impedance mismatch and reducing the ripple.

Figure 5:
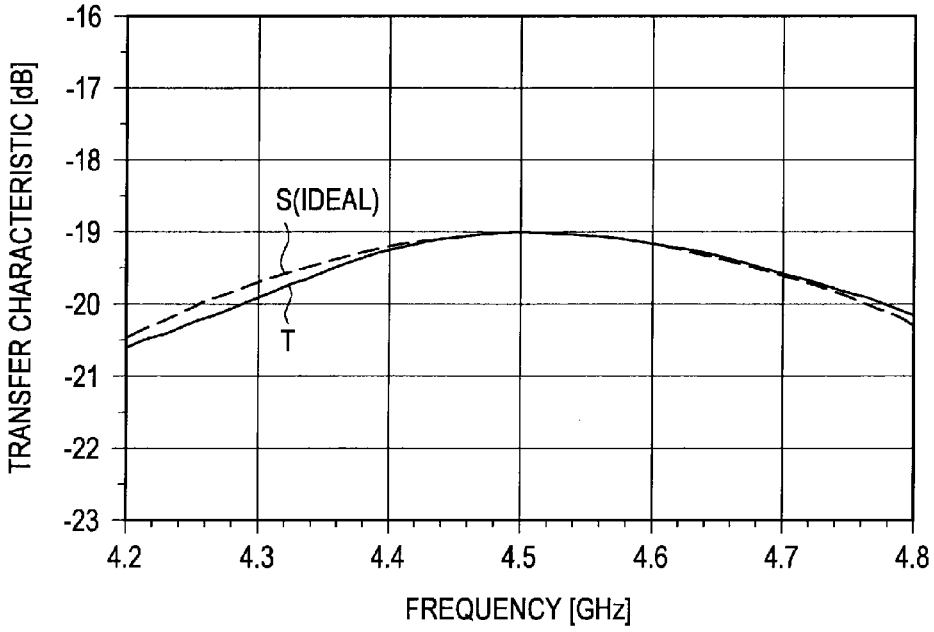
FIG. 5 is a graph comparing transfer characteristics in the case where impedance matching is obtained and in the case of the first embodiment.

When the phase $\phi 1$ is 0° and the phase $\phi 2$ is 90°, numerical simulation using the ideal fifth order BPF shown in FIG. 12 and the ideal coupler shown in FIG. 13 gives the transfer characteristic shown in FIG. 5. Comparing FIG. 5 showing the transfer characteristic according to the embodiment and FIG. 14 showing the transfer characteristic according to the above-described related art, the curves substantially match between the ideal case (curve S) and the case of this embodiment (curve T) in FIG. 5, and the large ripple which has appeared in the related art is significantly reduced.

As described above, in the close proximity wireless communication system 10 according to the embodiment, it is possible to maintain good frequency characteristics of the band-pass filters 115 and 215 regardless of presence or absence of an impedance mismatch of the high frequency couplers 120 and 220 in the transmitter 100 and the receiver 200 which are used in a short distance of several centimeters utilizing an electrostatic field or an induction field, and to enable high-volume data communication using a broadband frequency between the transmitter 100 and the receiver 200 even when another communication system such as wireless LAN exists in close proximity.

According to FIGS. 3 and 4, as the electrical lengths of the distributed constant lines 125 and 225 mounted in the transmitter 100 and the receiver 200 become closer to each other, a large ripple occurs. Thus, by setting different electrical lengths to the distributed constant line 125 of the transmitter 100 and the distributed constant line 225 of the transmitter 200, the occurrence of a ripple can be suppressed. Further, the occurrence of a ripple can be minimized when the electrical length of one distributed constant line is set to produce a phase difference of 90°±180°×n (n is an integer of 0 or greater) with respect to the electrical length of the other distributed constant line. As a result, even if there is an impedance mismatch of the high frequency couplers, it is possible to provide good broadband characteristics without degrading the frequency characteristics of the band-pass filters.

Particularly, it is preferred that the electrical length of one distributed constant line is set to produce a phase difference of 90° with respect to the electrical length of the other distributed constant line. In this configuration, the occurrence of a ripple can be minimized, and the total sum of the electrical lengths of the distributed constant lines of the transmitter and the receiver can be also minimized.

The distributed constant line may be a microstrip line formed as a plane circuit on a printed board, a coaxial cable, or a transmission line formed as a part of the high frequency coupler. A specific configuration of the close proximity wireless communication system 10 is described hereinbelow.

Specific Configuration According to First Embodiment

Figure 6:
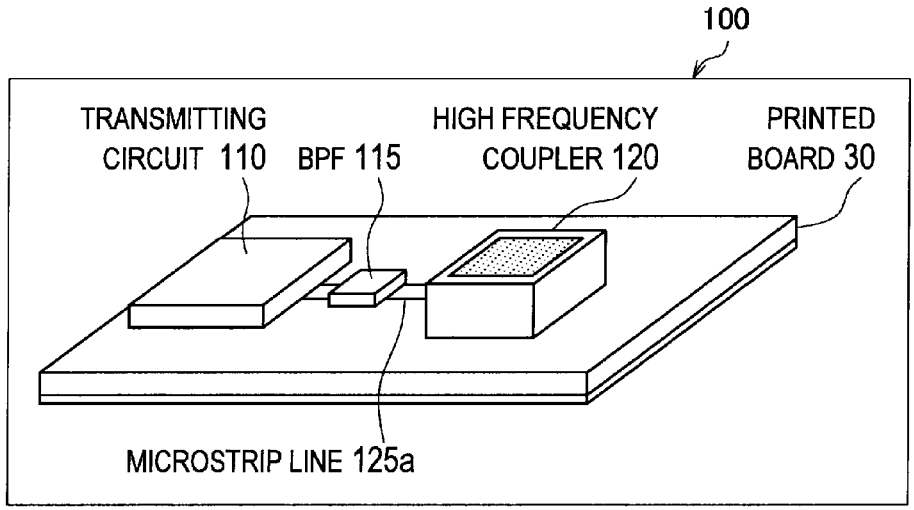
FIG. 6 is a specific block diagram of a transmitter and a receiver according to the first embodiment.
Figure 6:
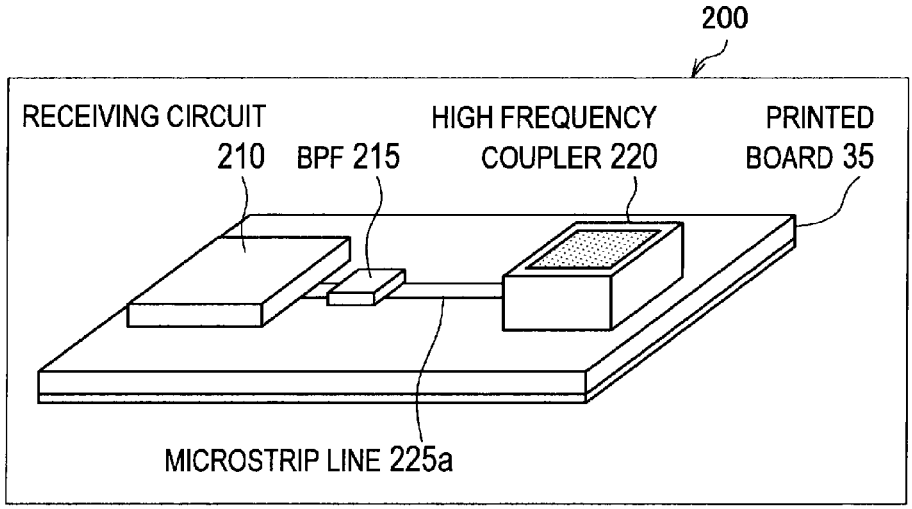

The case of using a microstrip line as the distributed constant line is described in the first embodiment. FIG. 6 shows the case where the high frequency coupler 120 and the BPF 115, and the high frequency coupler 220 and the BPF 215 are respectively connected by microstrip lines 125*a* and 225*a* having different electrical lengths. The microstrip lines 125*a* and 225*a* are respectively formed on printed boards 30 and 35.

The transmitter 100 and the receiver 200 have the same configuration except that the electrical lengths of the microstrip lines 125*a* and 225*a* are different. As described above, the transmitting circuit 110 can switch its operation to the receiving circuit 210, and, at that time, the receiving circuit 210 can switch its operation to the transmitting circuit 110. By making the transmitter 100 act as a receiver and the receiver 200 act as a transmitter, two-way data transmission is possible. Although the direction of high-frequency signals transmitted through a transmission line is also reversed in this case, because the microstrip lines 125*a* and 225*a* serving as the distributed constant lines 125 and 225 in this embodiment operate interactively, a ripple can be small as long as appropriate electrical lengths are set to produce a given phase difference.

For example, a difference in length between the microstrip lines 125*a* and 225*a* which produce a phase difference of 90° with a center frequency of 4.5 GHz is about 10 mm when a wavelength compaction ratio is assumed to be 0.6. In other words, the phase difference is 90° when one microstrip line is longer than the other microstrip line by about 10 mm.

When setting the lengths of the respective microstrip lines to produce a phase difference of 90°±180°×n (n is an integer of 0 or greater), the same effect as when a phase difference is 90° can be obtained. When a phase difference between the phase $\phi 1$ and the phase $\phi 2$ is 180°, because the second term of the denominator of Equation 4 is a dominant term for a frequency characteristic as described above, $(e^{-j2\phi 1}+e^{-j2\phi 2})$ and $2\times(\phi 1-\phi 2)=180$, and accordingly, $\phi 1-\phi 2=90$. Therefore, the occurrence of a ripple can be minimized in each case. However, as the value of n is greater, the total sum of the lengths of the microstrip lines 125*a* and 225*a* is longer. Thus, the case where the value of n is 0 (a phase difference is 90°) is preferable in terms of being able to minimize the total sum of the lengths of the microstrip lines 125*a* and 225*a*.

Specific Configuration According to Alternative Example 1

Figure 7:
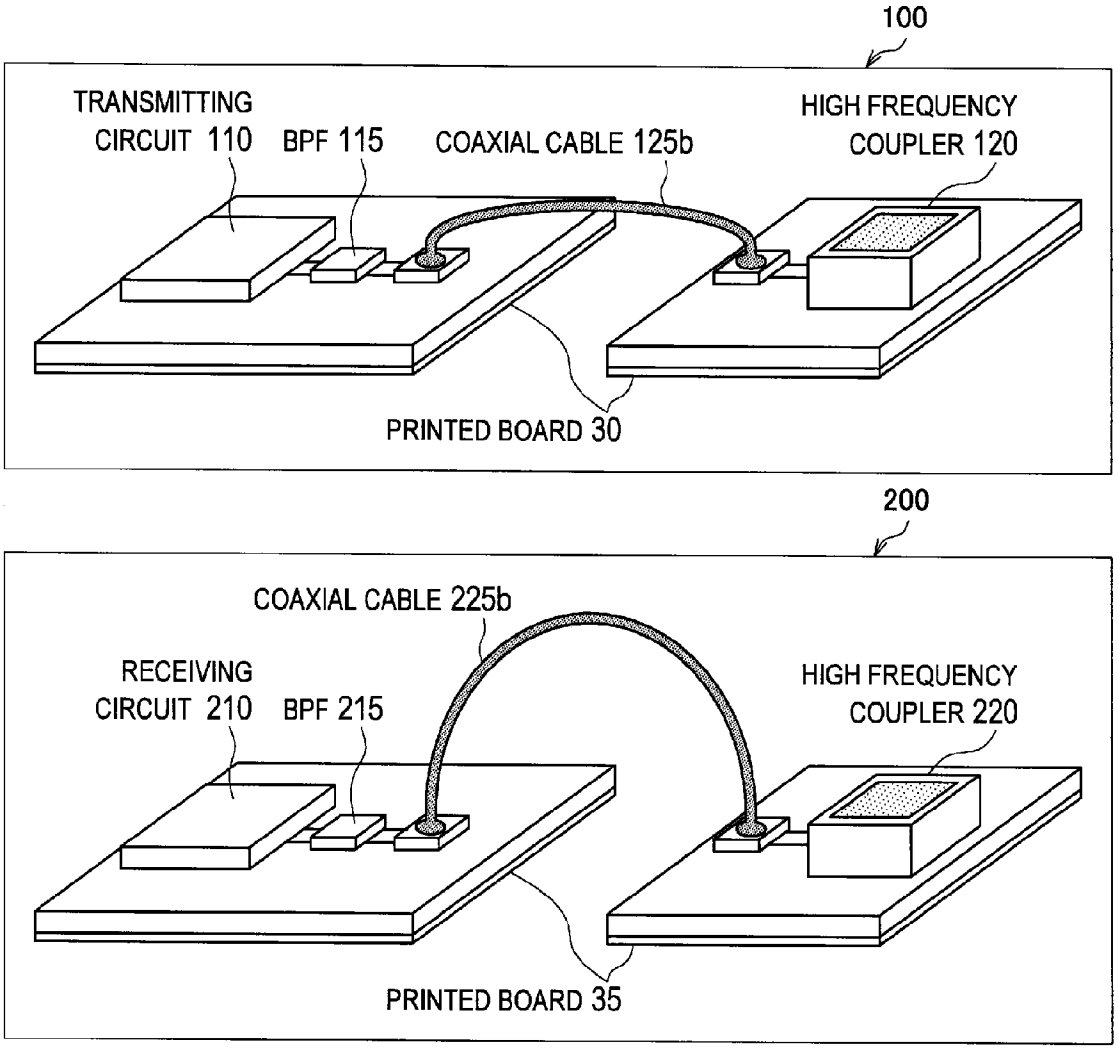
FIG. 7 is a specific block diagram of a transmitter and a receiver according to an alternative example 1 of the first embodiment.

As an alternative example 1 of the first embodiment, the case of using coaxial cables 125*b* and 225*b* as the distributed constant lines 125 and 225 is shown in FIG. 7. For example, a difference in electrical length between the coaxial cables 125*b* and 225*b* which produces a phase difference of 90° with a center frequency of 4.5 GHz is about 11 mm when a wavelength compaction ratio is assumed to be 0.67. Thus, the coaxial cable of either one of the transmitter 100 or the receiver 200 is set longer than the other one by about 11 mm.

Specific Configuration According to Alternative Example 2

Figure 8:
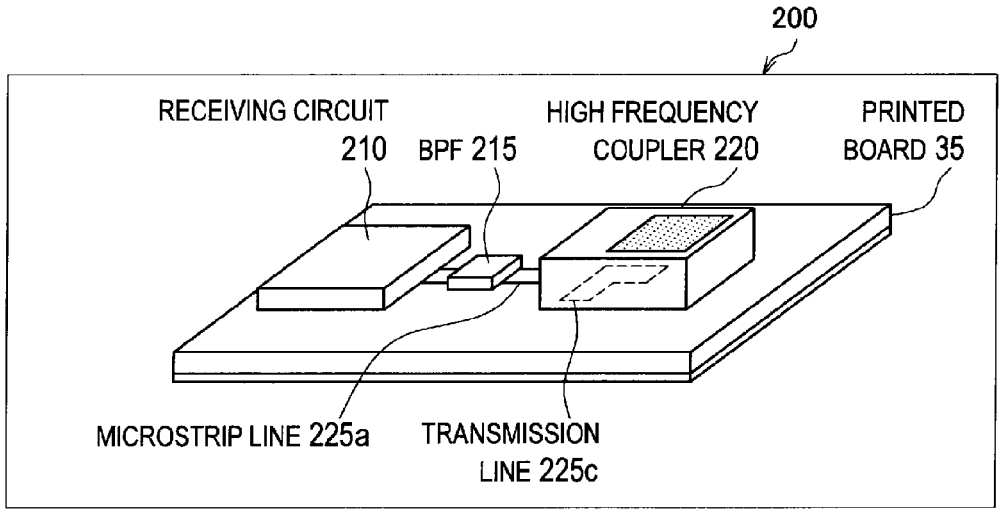
FIG. 8 is a specific block diagram of a receiver according to an alternative example 2 of the first embodiment.

As an alternative example 2 of the first embodiment, the case of using a transmission line 225*c* in a part of the high frequency coupler 220 as the distributed constant line 225 is shown in FIG. 8. Although the receiver 200 is illustrated in FIG. 8, at least one of the transmitter 100 and the receiver 200 may have the high frequency coupler which incorporates the transmission line. Note that the transmission line 225*c* may be a copper foil, for example.

Second Embodiment

Figure 9:
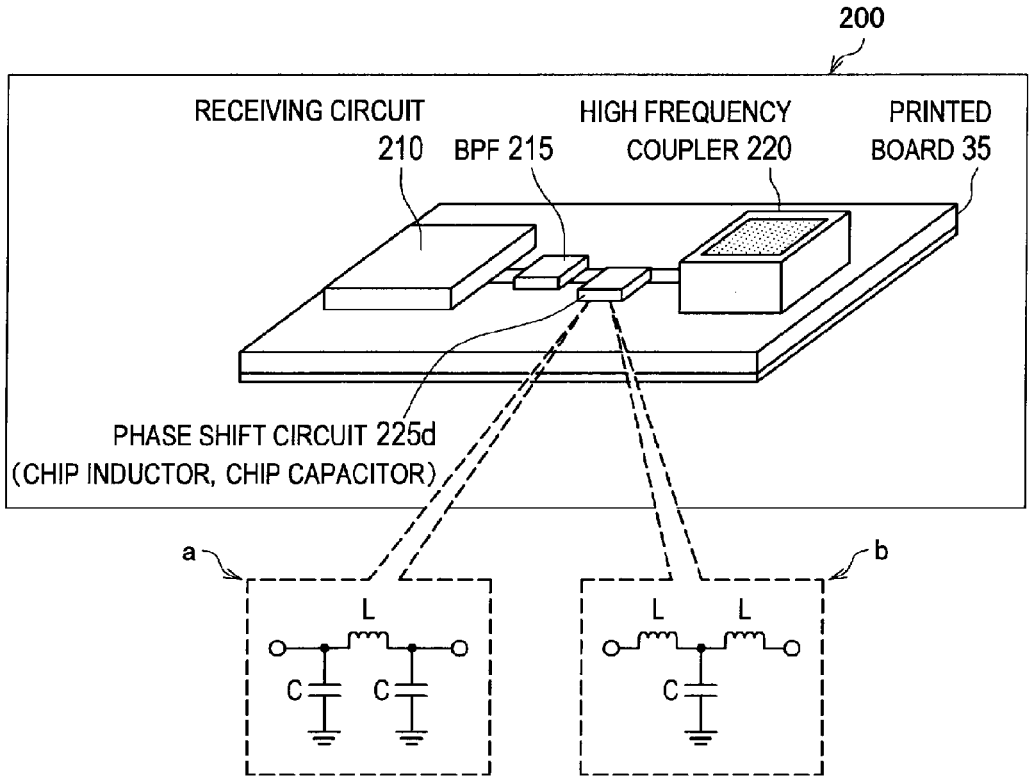
FIG. 9 is a specific block diagram of a receiver according to a second embodiment.

According to a second embodiment of the present invention, a phase shift circuit composed of an inductor and a capacitor of a lumped constant circuit is used instead of the distributed constant line. FIG. 9 shows an example of the receiver 200 equipped with the phase shift circuit 225*d*.

Specific Configuration According to Second Embodiment

In the case of the lumped constant circuit, the phase shift circuit 225*d* is composed of a low-pass equivalent circuit (L, C) of a chip inductor and a chip capacitor. An example of the phase shift circuit is shown in a and b in FIG. 9. Further, circuit constants are represented by the following Equations 5 and 6.

$$L=Z_c/\omega \qquad \text{Equation 5}$$

$$C=1/Z_c\omega \qquad \text{Equation 6}$$

$Z_c$ is a characteristic impedance of a distributed constant circuit.

According to this configuration, in the case of the lumped constant circuit also, as in the first embodiment, the occurrence of a ripple can be suppressed by setting the phase shift circuit of the transmitter and the receiver so that a phase difference is a desired value. Particularly, the occurrence of a ripple can be minimized by setting the phase shift circuit of the transmitter and the receiver so that a phase difference is 90° (or 90°±180°×n (n is an integer of 0 or greater)). In the case of the second embodiment as well, if a phase angle of the phase shift circuit on the transmitter side is different from a phase angle of the phase shift circuit on the receiver side, the occurrence of a ripple can be reduced compared to the case where there is no phase difference, and the effect is greater as the phase difference is closer to 90°.

Further, in the second embodiment, the device size can be reduced compared to the first embodiment.

Although preferred embodiments of the present invention are described in detail above with reference to the appended drawings, the present invention is not limited thereto. It should be understood by those skilled in the art that various modifications, combinations, sub-combinations and alterations may occur depending on design requirements and other factors insofar as they are within the scope of the appended claims or the equivalents thereof.

The present application contains subject matter related to that disclosed in Japanese Priority Patent Application JP2010-096892 filed in the Japan Patent Office on Apr. 20, 2010, the entire content of which is hereby incorporated by reference.

What is claimed is:

1. A communication device comprising:

a communication circuit unit to process a high-frequency signal for transmitting data, a band-pass filter, a high frequency coupler, and a first distributed constant line connecting the high frequency coupler and the band-pass filter, wherein:

the communication device functions as at least one of a transmitter and a receiver, and a first electrical length of the first distributed constant line is different from a second electrical length of a second distributed constant line connecting a high frequency coupler and a band-pass filter of a transmitter or a receiver at another communication device.

2. The communication device according to claim 1, wherein:

the first electrical length is set to produce a phase difference of 90°±180°×n (n is an integer greater than or equal to 0) with respect to the second electrical length.

3. The communication device according to claim 2, wherein:

the first electrical length is set to produce a phase difference of 90° with respect to the second electrical length.

4. The communication device according to claim 1, wherein:

the first distributed constant line is a microstrip line formed on a printed board.

5. The communication device according to claim 1, wherein:

the first distributed constant line is a coaxial cable.

6. The communication device according to claim 1, wherein:

the first distributed constant line is a transmission line formed in a part of the high frequency coupler.

7. A communication system comprising:

a transmitter and a receiver, each including a communication circuit unit to process a high-frequency signal for transmitting data, a band-pass filter, and a high frequency coupler, a first distributed constant line connecting the high frequency coupler and the band-pass filter of the transmitter, and a second distributed constant line connecting the high frequency coupler and the band-pass filter of the receiver, wherein an electrical length of the first distributed constant line is different from an electrical length of the second distributed constant line.

8. A communication device comprising:

a communication circuit unit to process a high-frequency signal for transmitting data, a band-pass filter, a high frequency coupler, and a phase shift circuit placed between the high frequency coupler and the band-pass filter, wherein:

the communication device functions as at least one of a transmitter and a receiver, a phase angle of the phase shift circuit is different from a phase angle of a phase shift circuit placed between a high frequency coupler and a band-pass filter of a transmitter or a receiver at another communication device.

9. The communication device according to claim 8, wherein:

the phase shift circuit is set to produce a phase difference of 90°±180°×n (n is an integer greater than or equal to 0) with respect to the phase shift circuit of the transmitter or the receiver at the other communication device.

10. The communication device according to claim 9, wherein:

the phase shift circuit is set to produce a phase difference of 90° with respect to the phase shift circuit of the transmitter or the receiver at the other communication device.

11. The communication device according to claim 8, wherein:

the phase shift circuit is a lumped constant circuit composed of an inductor or a capacitor.

12. A communication system comprising:

a transmitter and a receiver, each including a communication circuit unit to process a high-frequency signal for transmitting data, a band-pass filter, and a high frequency coupler, a phase shift circuit placed between the high frequency coupler and the band-pass filter of the transmitter, and a phase shift circuit placed between the high frequency coupler and the band-pass filter of the receiver, wherein a phase angle of the phase shift circuit of the transmitter is different from a phase angle of the phase shift circuit of the receiver.

* * * * *